US005588709A

United States Patent [19]

Lewallen, Sr.

[11] Patent Number: 5,588,709

[45] Date of Patent: Dec. 31, 1996

[54] KNOCKDOWN SEAT

[76] Inventor: William J. Lewallen, Sr., 12026 Co. Rd L., Napoleon, Ohio 43545

[21] Appl. No.: 494,953

[22] Filed: Jun. 26, 1995

[51] Int. Cl.[6] ..... A47C 4/03

[52] U.S. Cl. ..... 297/440.19; 297/447.1

[58] Field of Search ..... 297/440.13, 440.15, 297/440.19, 447.1; 403/346, 347, 400; 108/153, 180

[56] References Cited

U.S. PATENT DOCUMENTS

| | | | |
|---|---|---|---|
| 2,021,242 | 11/1935 | Reyniers | 297/440.16 |
| 3,427,074 | 2/1969 | Whyte | 297/447.1 X |
| 3,485,527 | 12/1969 | Barghout | 297/440.13 |
| 3,752,532 | 8/1973 | Yarus | 297/440.19 |
| 3,847,435 | 11/1974 | Skinner | 297/440.19 |
| 4,846,530 | 7/1989 | Noble | 297/440.19 |

*Primary Examiner*—Peter R. Brown

[57] ABSTRACT

A seat for supporting an individual relative to a ground surface. The inventive device includes a back panel having a receiving aperture directed therethrough. A seat panel is shaped so as to define a rear support leg positionable through the back panel receiving aperture to support the back panel in an inclined orientation such that an individual can sit on a seat bottom of the seat panel and lean against a back rest of the back panel.

2 Claims, 3 Drawing Sheets

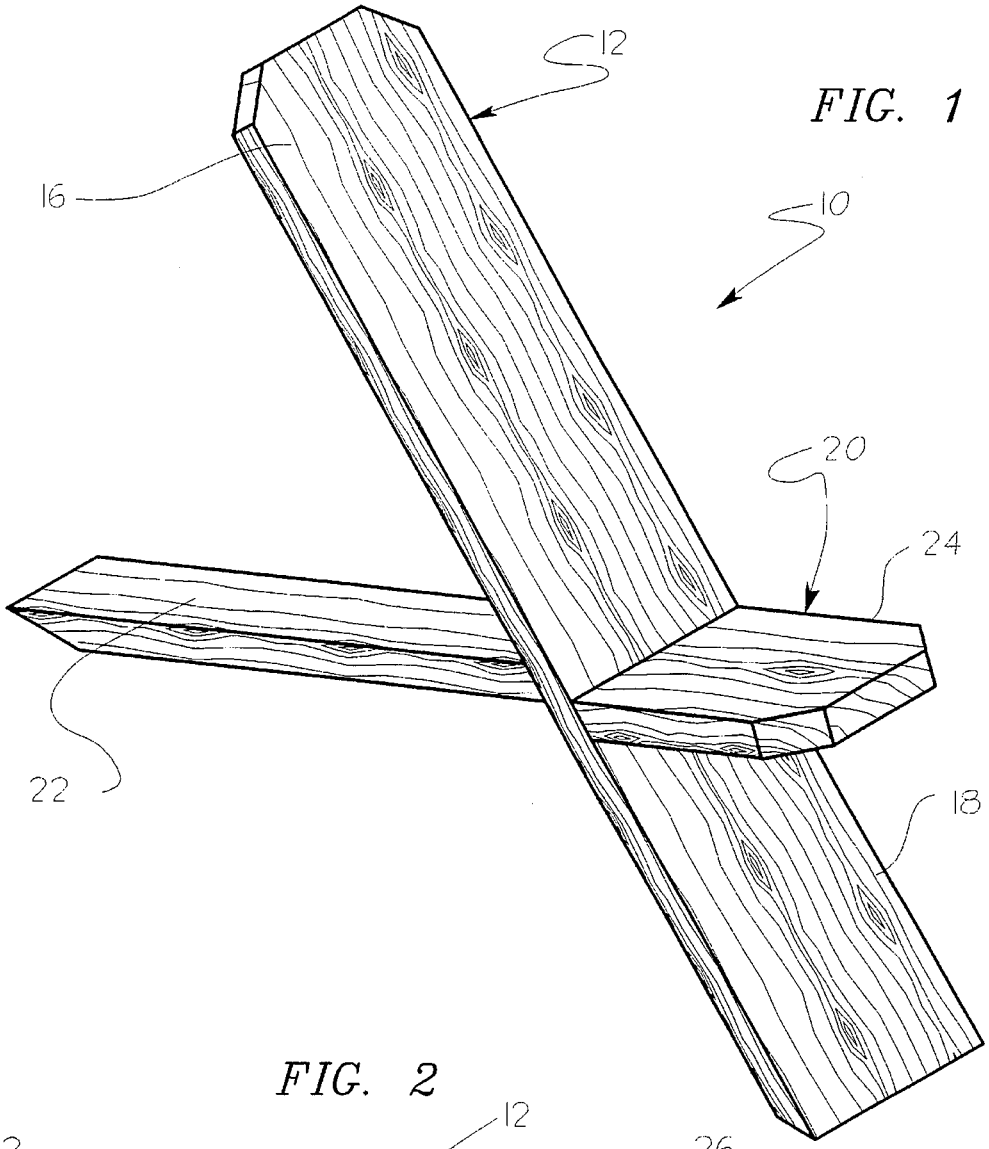
FIG. 1
FIG. 2
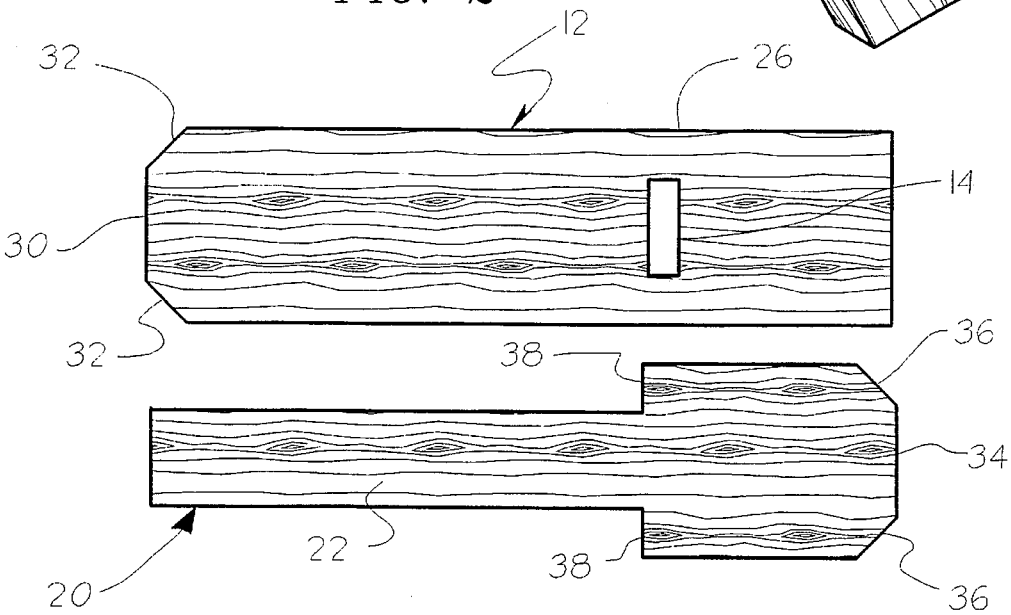

KNOCKDOWN SEAT

BACKGROUND OF THE INVENTION

1. Field of the Invention

The present invention relates to seating structures and more particularly pertains to a knockdown seat for supporting an individual relative to a ground surface.

2. Description of the Prior Art

The use of seating structures is known in the prior art. More specifically, seating structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art seating structures include U.S. Pat. No. 5,168,825; U.S. Pat. No. 4,077,668; U.S. Pat. 4,341,417; U.S. Pat. 3,861,746; U.S. Pat. 4,745,262; and U.S. Pat. No. 5,177,737.

While these devices fulfill their respective, particular objectives and requirements, the aforementioned patents do not disclose a knockdown seat for supporting an individual relative to a ground surface which includes a back panel having a receiving aperture directed therethrough, and a seat panel shaped so as to define a rear support leg positionable through the back panel receiving aperture to support the back panel in an inclined orientation.

In these respects, the knockdown seat according to the present invention substantially departs from the conventional concepts and designs of the prior art, and in so doing provides an apparatus primarily developed for the purpose of supporting an individual relative to a ground surface.

SUMMARY OF THE INVENTION

In view of the foregoing disadvantages inherent in the known types of seating structures now present in the prior art, the present invention provides a new knockdown seat construction wherein the same can be utilized for supporting an individual relative to a ground surface. As such, the general purpose of the present invention, which will be described subsequently in greater detail, is to provide a new knockdown seat apparatus and method which has many of the advantages of the seating structures mentioned heretofore and many novel features that result in a knockdown seat which is not anticipated, rendered obvious, suggested, or even implied by any of the prior art seating structures, either alone or in any combination thereof.

To attain this, the present invention generally comprises a seat for supporting an individual relative to a ground surface. The inventive device includes a back panel having a receiving aperture directed therethrough. A seat panel is shaped so as to define a rear support leg positionable through the back panel receiving aperture to support the back panel in an inclined orientation such that an individual can sit on a seat bottom of the seat panel and lean against a back rest of the back panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new knockdown seat apparatus and method which has many of the advantages of the seating structures mentioned heretofore and many novel features that result in a knockdown seat which is not anticipated, rendered obvious, suggested, or even implied by any of the prior art seating structures, either alone or in any combination thereof.

It is another object of the present invention to provide a new knockdown seat which may be easily and efficiently manufactured and marketed.

It is a further object of the present invention to provide a new knockdown seat which is of a durable and reliable construction.

An even further object of the present invention is to provide a new knockdown seat which is susceptible of a low cost of manufacture with regard to both materials and labor, and which accordingly is then susceptible of low prices of sale to the consuming public, thereby making such knockdown seats economically available to the buying public.

Still yet another object of the present invention is to provide a new knockdown seat which provides in the apparatuses and methods of the prior art some of the advantages thereof, while simultaneously overcoming some of the disadvantages normally associated therewith.

Still another object of the present invention is to provide a new knockdown seat for supporting an individual relative to a ground surface.

Yet another object of the present invention is to provide a new knockdown seat which includes a back panel having a receiving aperture directed therethrough, and a seat panel shaped so as to define a rear support leg positionable through the back panel receiving aperture to support the back panel in an inclined orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a knockdown seat according to the present invention.

FIG. 2 is a top plan view of the invention in a separated configuration.

FIG.,4 is a side elevation view thereof.

Figure 5:
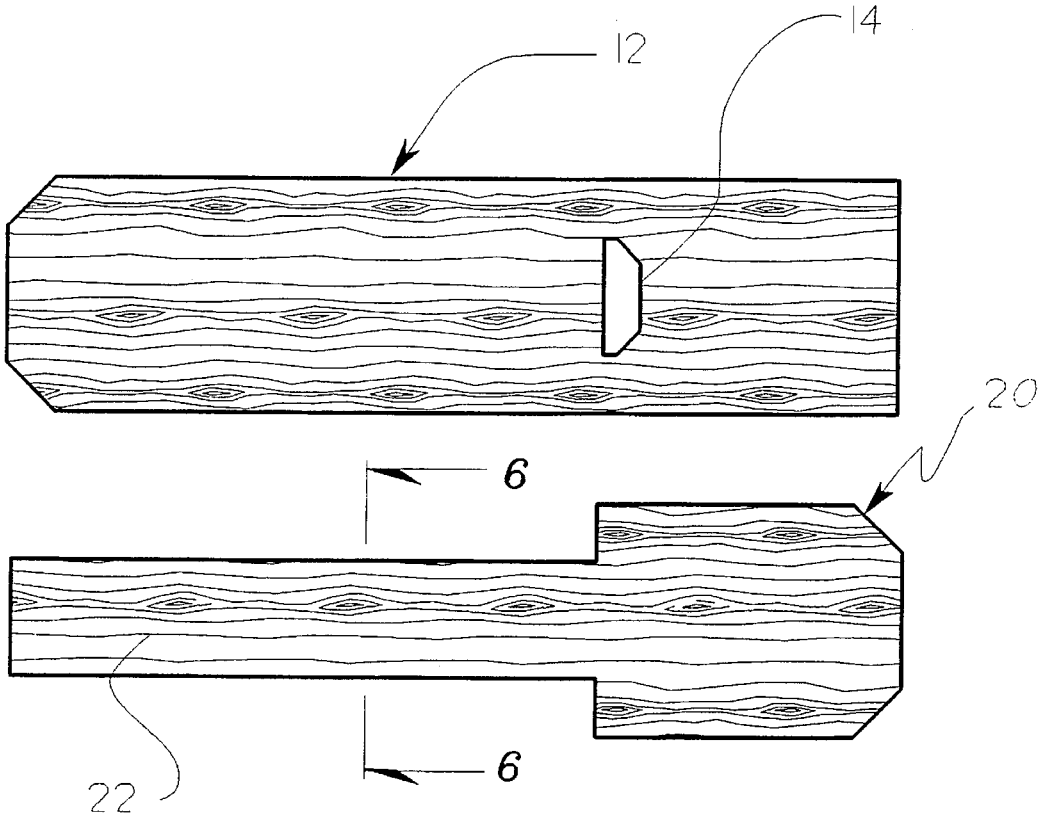

FIG. 5 is a top plan view of an alternative form of the present invention in a separated configuration.

Figure 6:
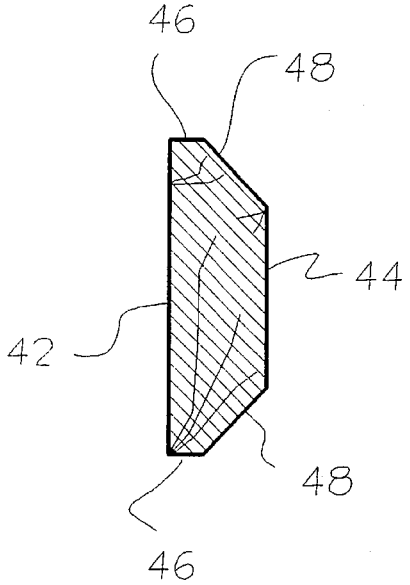

FIG. 6 is a cross-sectional view taken along line 6—6 of FIG. 5.

DESCRIPTION OF THE PREFERRED EMBODIMENT

With reference now to the drawings, and in particular to FIGS. 1—6 thereof, a new knockdown seat embodying the principles and concepts of the present invention and generally designated by the reference numeral 10 will be described.

More specifically, it will be noted that the knockdown seat 10 comprises a back panel 12 of substantially elongated planar configuration which is shaped so as to define a receiving aperture 14 directed therethrough. The receiving aperture 14 separates the back panel 12 into a back rest 16 extending in a first direction from the receiving aperture, and a front support leg 18 extending in an opposite second direction from the receiving aperture 14. A seat panel 20 is shaped so as to define a rear support leg 22 which extends through the receiving aperture 14 of the back panel 12. The seat panel 20 is further shaped so as to define a seat bottom 24 which resides adjacent to a front face of the back panel 12, with the rear support leg 22 projecting through the receiving aperture 14 and extending from a rear face of the back panel. By this structure, an individual can selectively position the rear support leg 22 through the receiving aperture 14 to assemble the device into the orientation illustrated in FIG. 1, whereby the individual may then reside upon the seat bottom 24 and lean against the back rest 16 of the respective seat panel 20 and back panel 12.

Figure 3:
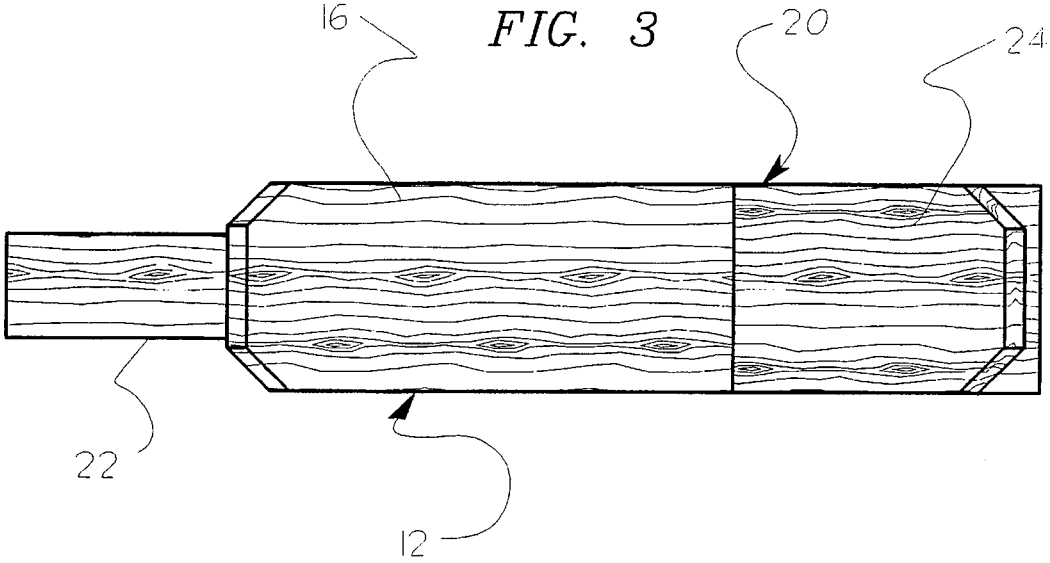
FIG. 3 is a top plan view of the invention in an assembled configuration.
Figure 4:
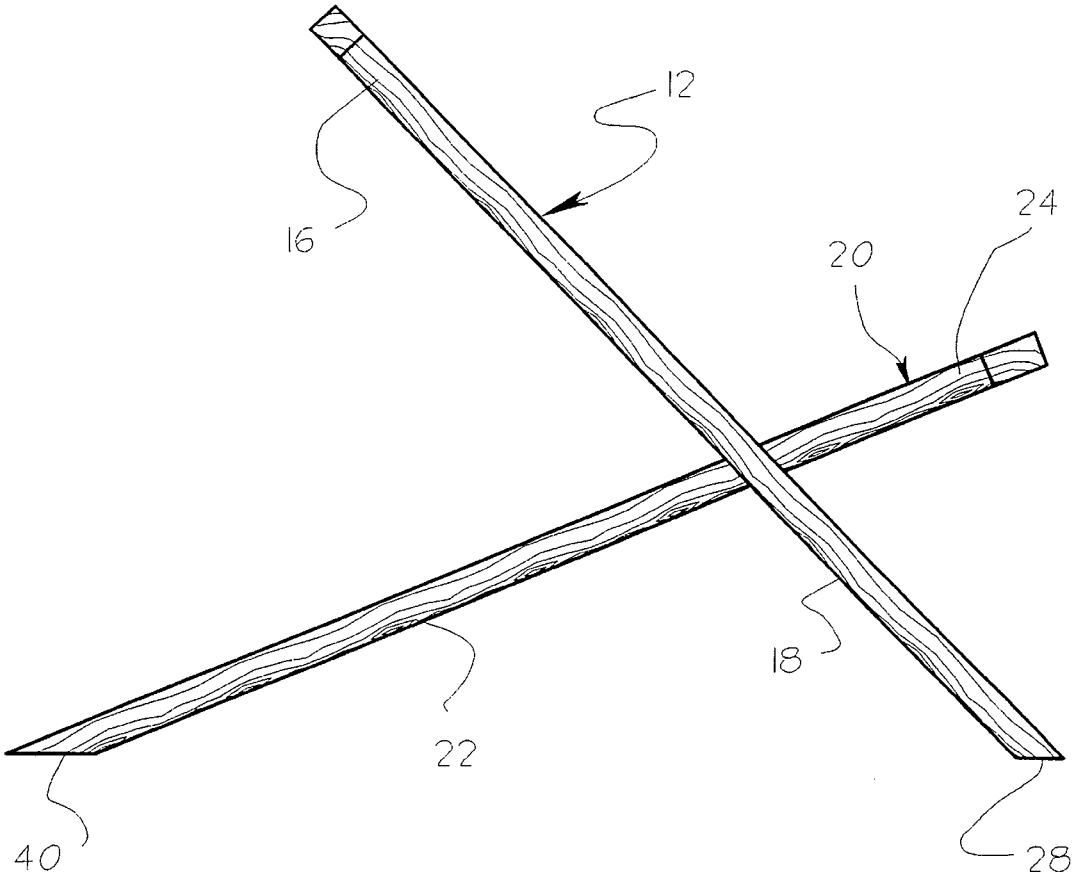

Referring now to FIGS. 2 through 4 wherein the present invention 10 is illustrated in detail, it can be shown that the back panel 12 is shaped so as to define longitudinal edges 26 extending in a substantially spaced and parallel orientation along a length of the back panel. The front support leg 18 of the back panel 12 is shaped so as to define a bevelled engaging end 28 extending substantially orthogonally between the longitudinal edges 26 of the back panel which is oriented so as to flatly engage a ground surface beneath the device such as is illustrated in FIG. 4 of the drawings. Further, the back rest 16 is shaped so as to define an upper edge 30 extending substantially orthogonally with respect to the longitudinal edges 26 of the back panel 12, with angled corner edges 32 extending at an oblique angle between the upper edge 30 and the respective longitudinal edges 26. The angled corner edges 32 provide a degree of comfort to an individual residing upon the device 10 as shoulder blades of an individual may project beyond the angled corner edges 32 so as to permit rearward and lateral leaning relative to the back panel 12 by the individual when seated in the device 10.

With continuing reference to FIGS. 2 through 4, it can be shown that the seat bottom 24 of the seat panel 20 is shaped so as to define spaced and parallel longitudinal edges oriented a first transverse distance apart. The seat bottom 24 further defines a forward edge 34 extending substantially orthogonally relative to the longitudinal edges of the seat bottom 24, with angled corner edges 36 extending at an oblique angle between opposed ends of the forward edge 34 and the respective longitudinal edges of the seat bottom 24. The angled corner edges 36 provide a degree of comfort to an individual seated on the device 10 as the individual's leg can be angled laterally outward so as to project substantially orthogonally from the angled corner edges 36.

With continuing reference to FIGS. 2 through 4, it can be shown that the rear support leg 22 of the seat panel 20 also includes substantially spaced and parallel longitudinal edges which are spaced a second transverse distance apart, wherein the first transverse distance is substantially greater than the second transverse distance so as to define a reduced transverse dimension of the rear support leg 22 relative to the seat bottom 24. Accordingly, the seat panel 20 includes abutment edges 38 extending substantially orthogonally between the longitudinal edges of the seat bottom 24 and the longitudinal edges of the rear support leg 22. The abutment edges 38 are operable to engage a front face of the back panel 12 when the rear support leg 22 of the seat panel 20 is positioned through the receiving aperture 14 of the back panel. As shown in FIG. 4, the rear support leg 22 can include a bevelled engaging end 40 extending substantially orthogonally between the longitudinal edges thereof and angled so as to flatly engage a ground surface when the device is assembled as shown in FIG. 4.

Preferably, and as shown in FIG. 2, the receiving aperture 14 is substantially rectangular in shape so as to accommodate the correspondingly shaped rear support leg 22. To ensure proper orientation of the rear support leg 22 relative to the back panel 12 such that the bevelled engaging end 40 of the rear support leg is properly oriented relative to a ground surface positioned beneath the device 10, the receiving aperture 14 can be desirably shaped as shown in FIG. 5 of the drawings. In this configuration of the invention 10, the rear support leg 22 of the seat panel 20 is correspondingly shaped to fit the receiving aperture 14 and includes a planar upper surface 42 oriented in a substantially spaced and parallel orientation relative to a planar lower surface. Orthogonal longitudinal edges 46 extend substantially orthogonally in a spaced and parallel orientation from the upper surface 42. The orthogonal longitudinal edges 46 intersect bevelled longitudinal edges 48 of planar configuration extending at an oblique angle between the respective orthogonal longitudinal edges 46 and the lower surface 44. By this structure, the rear support leg 22 can only be positioned through the receiving aperture 14 such that the bevelled engaging end 40 of the rear support leg is positioned for flat engagement with a ground surface.

In use, the knockdown seat 10 of the present invention can be easily utilized for supporting an individual relative to a ground surface. The ability of the seat panel 20 to be separated from the back panel 12 as defined by the structure of the present invention 10 permits the device 10 to be easily compacted for storage and/or transportation purposes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A knockdown seat comprising: a back panel of substantially elongated planar configuration shaped so as to define a receiving aperture directed therethrough, the receiving aperture separating the back panel into a back rest extending in a first direction from the receiving aperture, and a front support leg extending in an opposite second direction from the receiving aperture; a seat panel shaped so as to define a rear support leg which extends through the receiving aperture of the back panel, and a seat bottom which resides adjacent to a front face of the back panel, wherein the rear support leg projects through the receiving aperture and extends from a rear face of the back panel and where the bank panel is shaped so as to define longitudinal edges extending in a substantially spaced and parallel orientation along a length of the back panel, with the front support leg of the back panel being shaped so as to define a beveled engaging and extending substantially orthogonally between the longitudinal edges of the back panel and where the back rest is further shaped so as to define an upper edge extending substantially othrogonally with respect to the longitudinal edges of the back panel, and angled corner edges extending at an Oblique angle between the upper edge and the respective longitudinal edges, wherein the angled corner edges permit shoulder blades of an individual to project beyond the back panel and where the seat bottom of the seat panel is shaped so as to define spaced and parallel longitudinal edges oriented a first transverse distance apart, the seat bottom further including a forward edge extending substantially orthogonally relative to the longitudinal edges of the seat bottom, with angled corners edges extending at an oblique angle between opposed ends of the forward edge and the respective longitudinal edges of the seat bottom and where the rear support leg of the seat panel further includes substantially spaced and parallel longitudinal edges which are spaced a second transverse distance apart, wherein the first transverse distance is substantially greater than the second transverse distance so as to define a reduced transverse dimension of the rear support leg relative to the seat bottom and where the seat panel includes abutment edges extending substantially orthogonally between the longitudinal edges of the seat bottom and the longitudinal edges of the rear support leg, the abutment edges engaging the front face of the back panel when the rear support leg of the seat panel is positioned through the receiving aperture of the back panel and where the rear support leg is shaped so as to define a beveled engaging end extending substantially orthogonally between the longitudinal edges thereof and where the receiving aperture is shaped so as to accommodate corresponding shape of the rear support leg and where the rear support leg of the seat panel is shaped so as to define a planar upper surface oriented in a substantially spaced and parallel orientation to a planar lower surface, the support leg of the seat panel being further shaped so as to define orthogonal longitudinal edges extending substantially orthogonally in a spaced and parallel orientation from the upper surface, and beveled longitudinal edges of planar configuration extending at an oblique angle between the respective orthogonal edges and the lower surface increasing the rear support leg's strength.

2. The knockdown seat of claim 1, wherein the receiving aperture of the back panel is shaped so as to receive the rear support leg in only one orientation such that the bevelled engaging end of the rear support leg is positioned for flat engagement with a ground surface.

* * * * *